US009297376B2

(12) United States Patent
Sakoh et al.

(10) Patent No.: US 9,297,376 B2
(45) Date of Patent: Mar. 29, 2016

(54) SUPPLY PUMP

(71) Applicant: DENSO CORPORATION, Kariya, Aichi-pref. (JP)

(72) Inventors: Takaharu Sakoh, Kariya (JP); Katsumi Mori, Chiryu (JP); Nao Ogasawara, Kariya (JP)

(73) Assignee: DENSO CORPORATION, Kariya (JP)

( * ) Notice: Subject to any disclaimer, the term of this patent is extended or adjusted under 35 U.S.C. 154(b) by 250 days.

(21) Appl. No.: 13/755,708

(22) Filed: Jan. 31, 2013

(65) Prior Publication Data

US 2013/0195692 A1 Aug. 1, 2013

(30) Foreign Application Priority Data

Jan. 31, 2012 (JP) ..... 2012-18071

(51) Int. Cl.
*F04B 53/14* (2006.01)
*F04B 1/04* (2006.01)
*F04B 53/16* (2006.01)

(52) U.S. Cl.
CPC ..... *F04B 53/14* (2013.01); *F04B 1/0421* (2013.01); *F04B 1/0426* (2013.01); *F01L 2107/00* (2013.01); *F04B 53/16* (2013.01)

(58) Field of Classification Search
CPC ..... F04B 53/14; F04B 53/16; F04B 1/0426; F04B 1/0421; F01L 2107/00
USPC ..... 92/129, 165 PR
See application file for complete search history.

(56) References Cited

U.S. PATENT DOCUMENTS

| | | | | | |
|---|---|---|---|---|---|
| 2,463,374 | A | * | 3/1949 | Garday | 417/494 |
| 2,935,878 | A | * | 5/1960 | Wirsching | 74/55 |
| 3,139,076 | A | * | 6/1964 | Flaherty | 123/90.5 |
| 3,314,303 | A | * | 4/1967 | Maat | 74/569 |
| 3,610,057 | A | * | 10/1971 | Repen | 74/55 |
| 3,668,945 | A | * | 6/1972 | Hofmann | 74/569 |
| 4,195,610 | A | * | 4/1980 | Bastenhof | F02M 63/021 123/198 D |
| 4,754,737 | A | * | 7/1988 | Ishida et al. | 123/500 |
| 5,415,533 | A | * | 5/1995 | Egger et al. | 417/471 |

(Continued)

FOREIGN PATENT DOCUMENTS

| | | | |
|---|---|---|---|
| DE | 828326 | C * | 1/1952 |
| JP | 51-135223 | | 11/1976 |

(Continued)

OTHER PUBLICATIONS

DE828326 machine translation to English from Espacenet. 2014.*
Office Action (6 pages) dated Oct. 21, 2014 issued in corresponding Chinese Application No. 201310038590.2 and English translation (5 pages).

(Continued)

*Primary Examiner* — Nathaniel Wiehe
*Assistant Examiner* — Michael Quandt
(74) *Attorney, Agent, or Firm* — Nixon & Vanderhye PC

(57) ABSTRACT

A supply pump includes a housing, a tappet, a guide groove, and a stopper pin. The housing includes a cylindrical sliding wall. The tappet is configured to be reciprocated along the sliding wall. The guide groove is provided for one of the housing and the tappet. One end of the guide groove includes a tapered surface. The stopper pin is provided for the other one of the housing and the tappet. The stopper pin is fitted into the guide groove to stop rotation of the tappet relative to the housing. When the tappet is displaced abnormally in an upper direction, the tapered surface is pressed on an end of the stopper pin to be engaged with the stopper pin.

17 Claims, 4 Drawing Sheets

(56) References Cited

U.S. PATENT DOCUMENTS

| | | | | |
|---|---|---|---|---|
| 5,603,303 | A * | 2/1997 | Okajima et al. | 123/508 |
| 6,209,798 | B1 * | 4/2001 | Martin et al. | 239/88 |
| 6,854,432 | B2 * | 2/2005 | Hirano | 123/90.16 |
| 7,210,437 | B2 * | 5/2007 | Geyer | F01L 1/14 123/90.48 |
| 7,311,087 | B2 * | 12/2007 | Shaull et al. | 123/509 |
| 2005/0106049 | A1 | 5/2005 | Aoki et al. | |
| 2010/0154409 | A1 * | 6/2010 | Heinrich | 60/585 |
| 2011/0088506 | A1 | 4/2011 | Oishi et al. | |
| 2011/0259142 | A1 * | 10/2011 | Copper | F01L 1/146 74/569 |

FOREIGN PATENT DOCUMENTS

| | | |
|---|---|---|
| JP | 03-294653 | 12/1991 |
| JP | 2004-204761 | 7/2004 |
| JP | 2004-218459 | 8/2004 |
| JP | 2009-236033 | 10/2009 |
| JP | 2011-094596 | 5/2011 |
| WO | WO 2009/139296 | 11/2009 |

* cited by examiner

SUPPLY PUMP

CROSS REFERENCE TO RELATED APPLICATION

This application is based on Japanese Patent Application No. 2012-18071 filed on Jan. 31, 2012, the disclosure of which is incorporated herein by reference.

TECHNICAL FIELD

The present disclosure relates to a supply pump that pressure-feeds high-pressure fuel.

BACKGROUND

A conventional supply pump includes a high-pressure pump that pressure-feeds high-pressure fuel, and a pump drive part which drives each high-pressure pump by rotation of an engine (see JP-A-2011-094596).

The pump drive part includes a cam that is rotated by the engine, and a driving force transfer mechanism that converts rotational movement of the cam to reciprocating movement in upper and lower directions (axial direction) to transmit the reciprocating movement to a plunger of the high-pressure pump.

The conventional technology has the following issues. The supply pump is provided not to cause a failure. Nevertheless, in case of any failure in the conventional supply pump, a tappet, which is provided for the driving force transfer mechanism, may excessively slide repeatedly in the upper and lower directions. If the tappet abnormally descends, a damage state of the supply pump may be made worse, for example, as a result of biting the cam by a part of the driving force transfer mechanism.

SUMMARY

The present disclosure addresses at least one of the above issues.

According to the present disclosure, there is provided a supply pump including a housing, a tappet, a guide groove, and a stopper pin. The housing includes a cylindrical sliding wall. The tappet is configured to be reciprocated along the sliding wall. A displacement direction of the tappet at time of compression operation of the supply pump is defined as an upper direction. A displacement direction of the tappet at time of suction operation of the supply pump is defined as a lower direction. The guide groove is provided for one of the housing and the tappet. One end of the guide groove includes a tapered surface. The stopper pin is provided for the other one of the housing and the tappet. The stopper pin is fitted into the guide groove to stop rotation of the tappet relative to the housing. When the tappet is displaced abnormally in the upper direction, the tapered surface is pressed on an end of the stopper pin to be engaged with the stopper pin.

On the assumption that a failure is caused in the supply pump, when the tappet abnormally ascends, the tapered surface provided for the guide groove and the end of the stopper pin cross (collide) in the upper and lower directions, and the end of the stopper pin is thereby pressed against the tapered surface. As a result, the stopper pin bites (is engaged with) the tapered surface, and the tappet is thereby fixed (locked) at an ascended position. Accordingly, abnormal descent of the tappet can be prevented, and deterioration of damage to the supply pump caused by the abnormal descent of the tappet can be avoided. Therefore, the damage to the supply pump can be limited.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
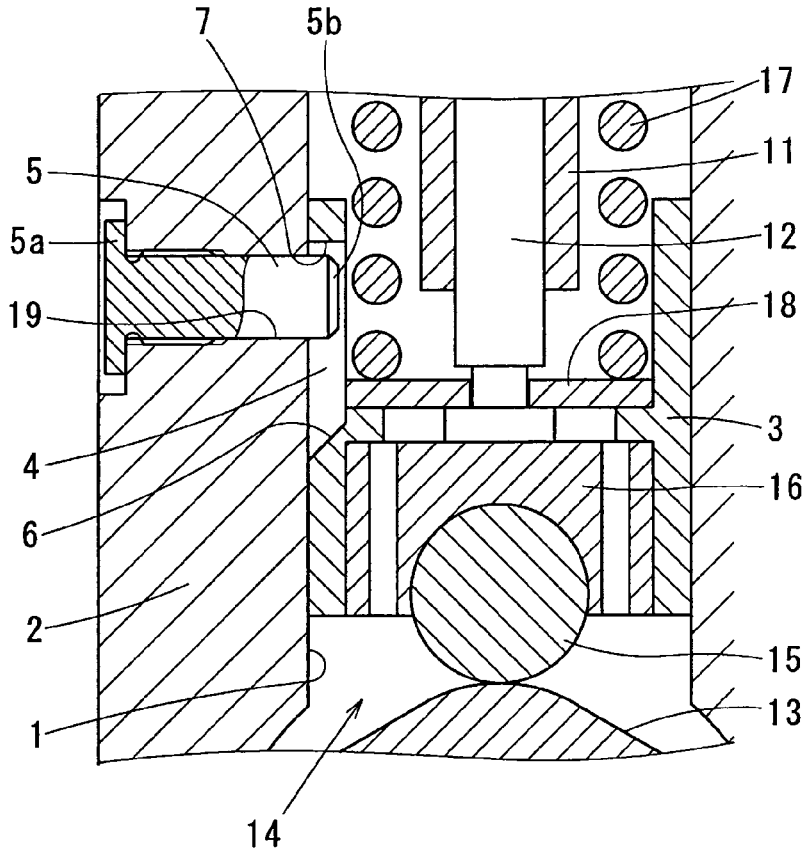
FIG. 1 is a sectional view illustrating a main feature of a supply pump in accordance with a first embodiment.

In the following description, explanation of a supply pump will be given with a displacement direction of a tappet at the time of compression operation of a high-pressure pump provided for the supply pump defined as "up", and with the displacement direction of the tappet at the time of suction operation of the high-pressure pump defined as "down or lower". Nevertheless, these upper and lower directions are only explanatory directions, and upper and lower directions (top and bottom directions) when the supply pump is disposed in a vehicle are not limited.

Embodiments will be described with reference to the accompanying drawings. A supply pump is driven by an engine to pressurize the fuel drawn to a pressurizing chamber and to pressure-feed the fuel. The supply pump includes a housing 2 that includes therein a cylindrical sliding wall 1 extending in upper and lower directions, and a tappet 3 that is reciprocated along the sliding wall 1.

A guide groove 4, which extends in the upper and lower directions, is provided for one of the tappet 3 and the housing 2. A stopper pin 5, which is fitted into the guide groove 4, is provided for the other one of the tappet 3 and the housing 2. By fitting the stopper pin 5 into the guide groove 4 as above, rotation of the tappet 3 relative to the housing 2 can be stopped.

A tapered surface 6, which is pressed on an end of the stopper pin 5 to engage the stopper pin 5 only when the tappet 3 abnormally ascends so that the stopper pin 5 and the guide groove 4 collide, is provided for one end of the guide groove 4. In addition, a descent stopper 7, which is brought into contact with a side face of the stopper pin 5 when the tappet 3 abnormally descends to restrict a lowest descended position of the tappet 3, is provided at the other end of the guide groove 4 (side of the guide groove 4 different from the tapered surface 6).

Specific examples (embodiments) of the supply pump will be described below with reference to the accompanying drawings. The following embodiments only illustrate the specific examples, and needless to say, the present disclosure is not limited to the embodiments.

First Embodiment

A first embodiment will be described in reference to FIGS. 1 to 3. A common-rail system that is disposed in a diesel engine (compression ignition engine) includes injectors which inject fuel (such as light oil and alcohol fuel) compressed to high pressure into the engine, a common rail that stores high-pressure fuel supplied to each injector, the supply pump that pressure-feeds high-pressure fuel into this common rail, a feed pump (low-pressure pump) that pumps up fuel stored in a fuel tank to transfer the fuel to the supply pump, and a regulation valve that maintains pressure of the fuel supplied to the supply pump from this feed pump at a constant pressure.

The supply pump is a two-line type pump, and includes two high-pressure pumps that compress the fuel pumped up by the feed pump to high pressure and that discharge the fuel, a pump drive part that is provided for each high-pressure pump to drive the high-pressure pump by rotation of the engine, and a fuel metering valve that is provided for each high-pressure pump to regulate the amount of fuel supplied to the high-pressure pump from the feed pump.

The high-pressure pump includes a cylinder 11 that includes a cylinder wall (cylindrical wall) extending in the upper and lower directions, and a plunger 12 that is reciprocated in the upper and lower directions in the cylinder wall. When the plunger 12 goes down, the fuel regulated by the fuel metering valve is drawn into the pressurizing chamber formed at an upper part of the cylinder wall. When the plunger 12 goes up, the fuel drawn into the pressurizing chamber is compressed, and the compressed fuel is pressure-fed into the common-rail via a check valve.

The pump drive part includes a cam 13 that is rotated by the engine, and a driving force transfer mechanism 14 that is disposed between the plunger 12 and the cam 13 to convert rotational movement of the cam 13 into reciprocating movement in the upper and lower directions and to transmit the reciprocating movement to the plunger 12.

The driving force transfer mechanism 14 includes the housing 2 that accommodates this driving force transfer mechanism 14, the tappet 3 having a generally cylindrical shape that is supported slidably only in the upper and lower directions (driving direction of the plunger 12), a roller 15 that is pressed on the cam 13 to rotate along a cam surface, a shoe 16 that is disposed between the tappet 3 and the roller 15 to rotatably support the roller 15, a return spring 17 that presses the tappet 3 in the lower direction, and a seat 18 that is arranged between this return spring 17 and tappet 3 (specifically, between a lower end of the return spring 17 and a flanged part projecting radially inward of the tappet 3). The seat 18 is fixed to a lower end of the plunger 12 to transmit displacement of the tappet 3 in the upper and lower directions to the plunger 12.

This tappet 3 is reciprocated in the upper and lower directions along the cylindrical sliding wall 1 provided for the housing 2. A sliding clearance is provided between the sliding wall 1 and the tappet 3. When the cam 13 is rotated by the engine, the roller 15 is displaced in accordance with a cam mountain (cam nose) shape (cam profile) of the cam 13, so that the tappet 3 and the plunger 12 are driven in the upper and lower directions.

The rotation axis of the roller 15 needs to be held constantly parallel to the rotation axis of the cam 13. In this embodiment, by stopping the rotation of the tappet 3 relative to the housing 2, the rotation axis of the roller 15 is maintained constantly parallel to the rotation axis of the cam 13. Specifically, in this embodiment, by fitting the end of the stopper pin 5 attached to the housing 2 inside the guide groove 4 of the tappet 3 extending in the upper and lower directions, the rotation of the tappet 3 relative to the housing 2 is stopped.

Figure 2:
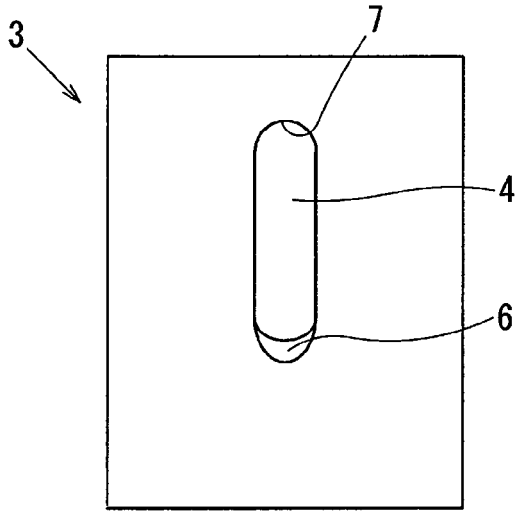
FIG. 2 is a diagram illustrating an elongate hole provided for a tappet according to the first embodiment.
Figure 3:
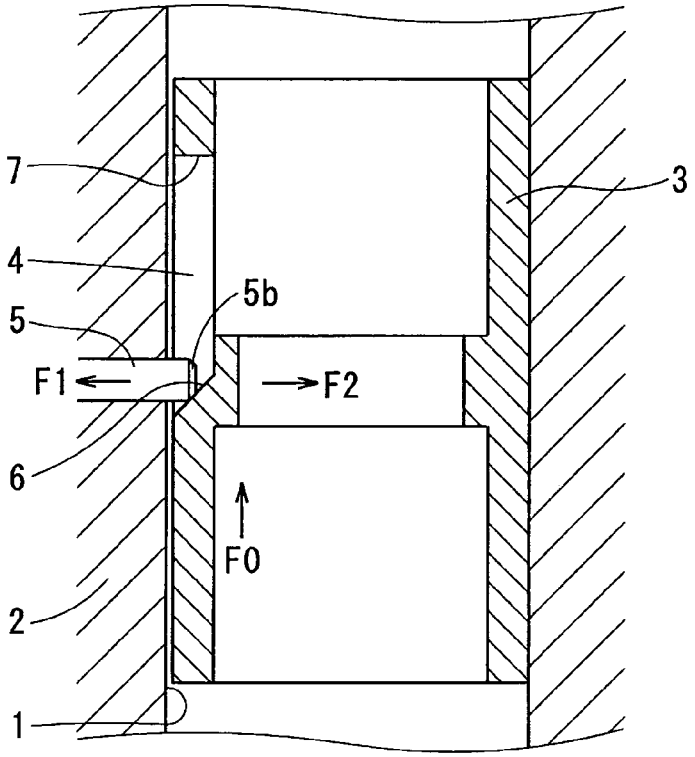
FIG. 3 is a diagram illustrating a state in which a stopper pin is engaged with a tapered surface according to the first embodiment.

For a specific example of the guide groove 4, the guide groove 4 of this embodiment is an elongate hole extending in the upper and lower directions as illustrated in FIG. 2. The width of this guide groove 4 in right and left directions (width of the guide groove 4 in a circumferential direction of the tappet 3: width for restricting the rotation of the tappet 3) is slightly larger than an outside diameter size of the stopper pin 5 which is fitted in the guide groove 4.

The stopper pin 5 of this embodiment is attached to a pin attachment hole 19 which is formed through the housing 2. Specifically, the pin attachment hole 19 is a through hole extending perpendicular to the sliding wall 1. A female screw for fastening the stopper pin 5 is formed inward of the hole 19, and a larger diameter hole (expanded diameter part) is provided radially outward of the hole 19 (at an outer part of the housing 2). A level difference due to this larger diameter hole is a seating surface on which a flange 5*a* (hereinafter described) of the stopper pin 5 is pressed to seal the fuel. The level difference is formed smoothly to prevent a fuel leakage.

An end side of the stopper pin 5 is fitted into the guide groove 4 with the stopper pin 5 fastened to the pin attachment hole 19. The stopper pin 5 includes the annular flange 5*a* which seals the pin attachment hole 19 in addition to a male screw which is entwisted into the pin attachment hole 19 (specifically, the above-described female screw). Moreover, a tool engagement part (e.g., hexagon socket) which is engaged with a plug-fastening tool is provided for an outer end surface of the stopper pin 5 (outer surface of the flange 5*a*). The stopper pin 5 illustrated in this embodiment is only a specific example, and a shape of the pin 5 and so forth can be variously changed.

The supply pump is provided not to cause a failure. Nevertheless, in case of any failure in the supply pump, the tappet 3 may excessively slide repeatedly in the upper and lower directions. If the tappet 3 abnormally descends, there is concern that a damage condition of the supply pump may become worse.

The supply pump of this embodiment includes the tapered surface 6, which is pressed on the end of the stopper pin 5 to engage the stopper pin 5 only when the tappet 3 abnormally ascends so that the stopper pin 5 and the guide groove 4 collide, at a lower end of the guide groove 4, as a means for permitting failure on the safe side and for limiting its damage to be as small as possible in case of any failure.

The tapered surface 6 is an outward inclined surface (which may be an inclined surface at a certain angle or which may be an inclined surface of a curved surface) with which the end of the stopper pin 5 is brought into contact when the tappet 3 abnormally ascends. As illustrated in FIG. 3, as a result of the application of ascending force F0 of the tappet 3 with the end of the stopper pin 5 in contact with the tapered surface 6, normal force F1 pushing out the stopper pin 5, and normal force F2 pressing the tappet 3 in a direction away from the stopper pin 5 are produced. Thus, "biting force" is generated at a contact part between the tapered surface 6 and the stopper pin 5.

The position of the tapered surface 6 with respect to the upper and lower directions of the tappet 3 is set at a position that is not in contact with the stopper pin 5 at the time of a normal stroke of the tappet 3, and a position that is in contact with the stopper pin 5 when the tappet 3 abnormally ascends out of a normal range by a predetermined amount (small set length).

On the other hand, the descent stopper 7 that is brought into contact with the side face of the stopper pin 5 (upper cylindrical surface of the pin 5) when the tappet 3 abnormally descends to limit the lowest descended position of the tappet 3 is provided at the upper end of the guide groove 4. The descent stopper 7 of this embodiment is an upper end of the elongate hole serving as the guide groove 4. An inner peripheral surface of the stopper 7 (inner peripheral surface of the upper end of the elongate hole) is formed in an arc surface that is parallel to a shaft center of the stopper pin 5 (see FIGS. 2 and 3). The descent stopper 7 is provided such that the stopper pin 5 is not engaged with the descent stopper 7 even if the tappet 3 abnormally descends so that the stopper pin 5 collides with the descent stopper 7.

The position of the descent stopper 7 with respect to the upper and lower directions of the tappet 3 is set at a position that is not in contact with the stopper pin 5 at the time of the normal stroke of the tappet 3, and a position that is in contact with the stopper pin 5 when the tappet 3 abnormally descends out of a normal range by a predetermined amount (small set length).

A first effect of the first embodiment will be described below. Provided that a failure is caused in the supply pump, when the tappet 3 abnormally ascends, the tapered surface 6 provided for the guide groove 4 and the end of the stopper pin 5 intersect (collide) with each other in the upper and lower directions. The end of the stopper pin 5 is thereby pressed against the tapered surface 6. Specifically, the normal force F1 pushing out the stopper pin 5, and the normal force F2 pressing the tappet 3 in a direction away from the stopper pin 5 are produced at the part where the end of the stopper pin 5 is in contact with the tapered surface 6.

By this normal force F2, an outer peripheral surface of the tappet 3 (specifically, an outer peripheral surface on a far side of the tappet 3 from the stopper pin 5) is pressed strongly on the sliding wall 1 of the housing 2. The tappet 3 is thereby fixed at the ascended position. In FIG. 3, it is illustrated that the tappet 3 is translated in a parallel manner in a transverse direction to be fixed due to the normal force F2. Alternatively, the tappet 3 may be fixed at a tilt. Furthermore, the tappet 3 may be fixed at the ascended position as a result of the biting of the stopper pin 5 by the tapered surface 6 (e.g., giving a small plastic deformation to the tapered surface 6) by the normal force F1 and the normal force F2.

As above, when the tappet 3 abnormally ascends, the tappet 3 can be fixed at the ascended position. Accordingly, an abnormal descent of the tappet 3 can be prevented. As a result, deterioration of damage to the supply pump caused by the abnormal descent of the tappet 3 can be avoided.

A second effect of the first embodiment will be described below. As described above, the supply pump of this embodiment includes the descent stopper 7 that restricts the lowest descended position of the tappet 3 at the upper end of the guide groove 4. Accordingly, in case of any failure in the supply pump, even if the tappet 3 abnormally descends before the tappet 3 is fixed at the ascended position by the tapered surface 6, a descent amount of the tappet 3 can be limited in a proactive manner. As a result, the deterioration of damage to the supply pump caused by the abnormal descent of the tappet 3 can be obviated.

A third effect of the first embodiment will be described below. The supply pump of this embodiment is a two-line type pump, and the tapered surface 6 is provided for the guide groove 4 of each of these two pumps. Accordingly, even if the tappet 3 of one pump is fixed at the ascended position in case of any failure, high-pressure fuel can be supplied to the common-rail by the other pump, and evacuation travelling of a vehicle can thereby be carried out.

A fourth effect of the first embodiment will be described below. As illustrated in FIG. 3, a chamfered part 5*b* having a tapered shape is formed at the end of the stopper pin 5 of this embodiment. By providing the chamfered part 5*b*, the normal forces F1, F2 can be generated smoothly from the ascending force F0 of the tappet 3. Accordingly, when the tappet 3 abnormally ascends, the tappet 3 can be reliably fixed at the ascended position. Moreover, because of the chamfered part 5*b*, at the time of attachment of the stopper pin 5, the end of the stopper pin 5 can easily be attached to the inside of the guide groove 4 (elongate hole).

A fifth effect of the first embodiment will be described below. As illustrated in FIG. 2, the guide groove 4 of this embodiment is an elongate hole that is provided for the tappet 3. Accordingly, the tapered surface 6 can be provided by inclining the lower end of the elongate hole, and the formation of the tapered surface 6 can be easily performed. In addition, the upper end of the elongate hole can be used as the descent stopper 7 in an unprocessed state.

Second Embodiment

Figure 4:
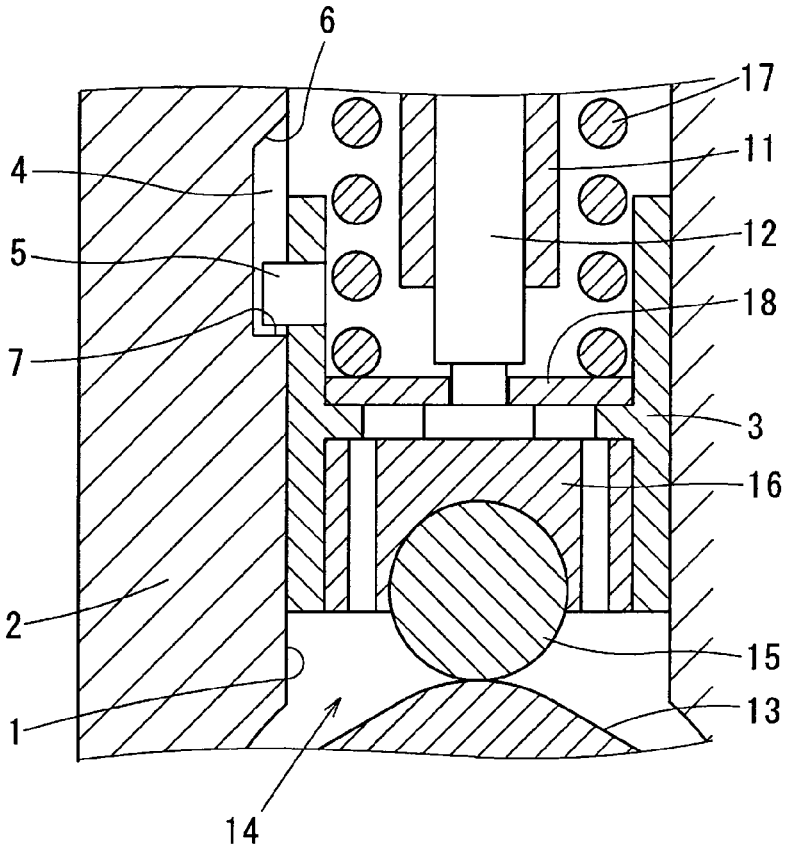
FIG. 4 is a sectional view illustrating a main feature of a supply pump in accordance with a second embodiment.

A second embodiment will be described below with reference to FIG. 4. In the following embodiment, the same numerals as in the above first embodiment indicate their corresponding functional objects. In the above first embodiment, it is illustrated that the guide groove 4 is provided for the tappet 3, and the stopper pin 5 is provided for the housing 2. In this second embodiment, a guide groove 4 is provided for a housing 2, and a stopper pin 5 is provided for a tappet 3. In addition, the stopper pin 5 may be provided integrally with the tappet 3, or may be provided separately from the tappet 3 to be fixed to the tappet 3.

In the case in which the guide groove 4 is provided for the housing 2 as above, a tapered surface 6 is provided at an upper end of the guide groove 4. In the case of the guide groove 4 being provided for the housing 2, a descent stopper 7 is provided at a lower end of the guide groove 4. As a result of such a configuration, similar effects to the first embodiment can be produced. Industrial applicability of the supply pump will be described below.

In the above embodiments, it is illustrated that the descent stopper 7 is provided for the guide groove 4. Alternatively, the descent stopper 7 may be eliminated, and only the tapered surface 6 may be provided, and a specific example thereof is illustrated in FIG. 5.

In the above embodiments, it is illustrated that the tapered surface 6 is provided directly for the member which is formed into the guide groove 4. Alternatively, another member including a tapered surface 6 may be fixed to the member which is formed into the guide groove 4 by means of a fixing technology such as welding. Thus, another member including the tapered surface 6 may be additionally fixed to the existing guide groove 4. The specific example thereof is illustrated in FIG. 5.

Figure 5:
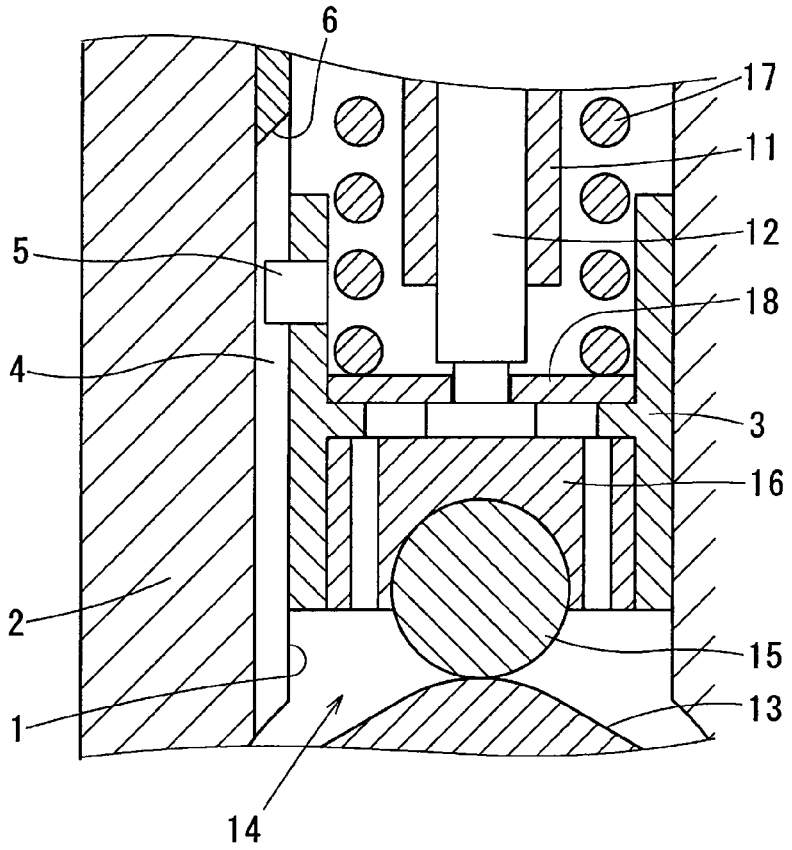
FIG. 5 is a sectional view illustrating a main feature of a supply pump in accordance with a modification.

Alternatively, unlike FIG. 5, another member including the descent stopper 7 may be additionally fixed to the existing guide groove 4.

In the above embodiments, it is illustrated that the roller 15 is rotatably supported by the shoe 16. Alternatively, the present disclosure may be applied to a supply pump in which the roller 15 is rotatably supported using a rotatable shaft (support shaft).

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A supply pump comprising:

a housing that includes a cylindrical sliding wall;

a tappet that is configured to be reciprocated along the sliding wall, wherein:

a displacement direction of the tappet at time of compression operation of the supply pump is defined as an upper direction;

a displacement direction of the tappet at time of suction operation of the supply pump is defined as a lower direction;

a guide groove that is provided for one of the housing and the tappet, wherein one end of the guide groove includes a tapered surface;

a stopper pin that is provided for the other one of the housing and the tappet, wherein:

the stopper pin is fitted into the guide groove to stop rotation of the tappet relative to the housing;

when the tappet is displaced in the upper direction abnormally as a result of the tappet being positioned outside of a predetermined range, the tapered surface is pressed on an end of the stopper pin to be engaged with the stopper pin;

the guide groove is provided for the tappet;

the tapered surface is provided only at a lower end of the guide groove, and an upper end of the guide groove is a non-tapered surface; and a longitudinal axis of the stopper pin passes through a central axis of the tappet.

2. The supply pump according to claim 1, wherein:

the other end of the guide groove includes a descent stopper; and when the tappet is displaced in the lower direction, the descent stopper is brought into contact with a lateral face of the stopper pin to limit a lowest descended position of the tappet.

3. The supply pump according to claim 1, wherein the supply pump is composed of two lines of pumps, each of which includes the guide groove having the tapered surface.

4. The supply pump according to claim 1, wherein the end of the stopper pin includes a chamfered part having a tapered shape.

5. The supply pump according to claim 1, wherein the guide groove is an elongate hole extending in the upper and lower directions.

6. The supply pump according to claim 1, wherein the stopper pin extends perpendicular to the cylindrical sliding wall.

7. The supply pump according to claim 1, wherein:

the guide groove, including the tapered surface, is provided for the tappet;

the stopper pin is provided for the housing; and the stopper pin includes a tapered surface that is configured to contact the tapered surface of the tappet when the tappet is displaced in the upper direction.

8. The supply pump according to claim 1, wherein the tapered surface is pressed on the end of the stopper pin when the tappet is positioned outside of the predetermined range as a result of a failure caused in the supply pump.

9. The supply pump according to claim 1, wherein the tappet is positioned within the predetermined range during a stroke of the tappet, and the tapered surface is pressed on the end of the stopper pin when the tappet is outside of the predetermined range.

10. A supply pump comprising:

a housing that includes a cylindrical sliding wall;

a tappet that is configured to be reciprocated along the sliding wall, wherein:

a displacement direction of the tappet at time of compression operation of the supply pump is defined as an upper direction;

a displacement direction of the tappet at time of suction operation of the supply pump is defined as a lower direction;

a guide groove that is provided for one of the housing and the tappet, wherein one end of the guide groove includes a tapered surface;

a stopper pin that is provided for the other one of the housing and the tappet, wherein:

the stopper pin is fitted into the guide groove to stop rotation of the tappet relative to the housing;

when the tappet is displaced in the upper direction, the tapered surface is pressed on an end of the stopper pin to be engaged with the stopper pin;

the other end of the guide groove includes a descent stopper;

when the tappet is displaced in the lower direction abnormally as a result of the tappet being positioned outside of a predetermined range, the descent stopper is brought into contact with a lateral face of the stopper pin to limit a lowest descended position of the tappet;

the guide groove is defined completely by the housing; and the tapered surface is provided only at an upper end of the guide groove.

11. The supply pump according to claim 10, wherein the supply pump is composed of two lines of pumps, each of which includes the guide groove having the tapered surface.

12. The supply pump according to claim 10, wherein the end of the stopper pin includes a chamfered part having a tapered shape.

13. The supply pump according to claim 10, wherein the guide groove is an elongate hole extending in the upper and lower directions.

14. The supply pump according to claim 10, wherein the stopper pin extends perpendicular to the cylindrical sliding wall.

15. The supply pump according to claim 10, wherein:

the guide groove, including the tapered surface, is defined completely by housing;

the stopper pin is provided for the housing tappet; and the stopper pin includes a tapered surface that is configured to contact the tapered surface of the housing when the tappet is displaced in the upper direction.

16. The supply pump according to claim 10, wherein the tapered surface is pressed on the end of the stopper pin when the tappet is positioned outside of the predetermined range as a result of a failure caused in the supply pump.

17. The supply pump according to claim 10, wherein the tappet is positioned within the predetermined range during a stroke of the tappet, and the tapered surface is pressed on the end of the stopper pin when the tappet is outside of the predetermined range.

* * * * *